US010981759B2

(12) United States Patent
Stolz

(10) Patent No.: US 10,981,759 B2
(45) Date of Patent: Apr. 20, 2021

(54) DUMP BLOCK FOR DRAGLINE RIGGING

(71) Applicant: Caterpillar Global Mining LLC, Tucson, AZ (US)

(72) Inventor: Michael R. Stolz, Franklin, WI (US)

(73) Assignee: Caterpillar Global Mining LLC, Tucson, AZ (US)

( * ) Notice: Subject to any disclaimer, the term of this patent is extended or adjusted under 35 U.S.C. 154(b) by 260 days.

(21) Appl. No.: 16/100,895

(22) Filed: Aug. 10, 2018

(65) Prior Publication Data

US 2020/0048055 A1 Feb. 13, 2020

(51) Int. Cl.
*B66D 3/04* (2006.01)
*E02F 3/58* (2006.01)

(52) U.S. Cl.
CPC . *B66D 3/04* (2013.01); *E02F 3/58* (2013.01)

(58) Field of Classification Search
CPC ..... B66D 3/04; B66D 3/00; E02F 3/48; E02F 3/58
See application file for complete search history.

(56) References Cited

U.S. PATENT DOCUMENTS 2,814,890 A * 12/1957 Mutti ..... E02F 3/60 37/399
2,904,906 A * 9/1959 Smith ..... E02F 3/60 37/399
4,640,496 A 2/1987 Van Hoomissen et al.
5,636,460 A 6/1997 Dretzka
5,970,636 A 10/1999 Briscoe et al.
6,209,234 B1 4/2001 Meyers
6,484,423 B1 11/2002 Murray
2010/0237641 A1* 9/2010 Drent ..... B66D 3/06 294/82.11
2011/0067275 A1* 3/2011 Doan ..... E02F 3/48 37/396
2012/0291318 A1* 11/2012 Attwood ..... B66C 3/125 37/399
2013/0152431 A1* 6/2013 Buhse ..... E02F 3/58 37/399
2015/0218775 A1* 8/2015 Attwood ..... E02F 9/006 37/399

FOREIGN PATENT DOCUMENTS

GB 222034 A 9/1924
GB 257656 A 9/1926

* cited by examiner

*Primary Examiner* — Jessica H Lutz
(74) *Attorney, Agent, or Firm* — Calfee, Halter & Griswold LLP

(57) ABSTRACT

A dump block assembly for a dragline bucket rigging assembly including a frame assembly having a first side frame and a second side frame attached to and parallel to the first side frame. The first side frame includes a first attachment portion having a first upper connection portion, a first lower connection portion opposite the first upper connection portion, and a first central connection portion spaced apart from and in between the first upper connection portion and the first lower connection portion. The second side frame includes a second attachment portion having a second upper connection portion, a second lower connection portion opposite the second upper connection portion, and a second central connection portion spaced apart from and in between the second upper connection portion and the second lower connection portion.

14 Claims, 9 Drawing Sheets

DUMP BLOCK FOR DRAGLINE RIGGING

TECHNICAL FIELD

This disclosure relates generally to dump block assemblies for dragline rigging assemblies, and more specifically to a universal dump block assembly capable of mounting within the dragline rigging assembly in multiple different configurations.

BACKGROUND

Dragline buckets are dragged through earthen material to collect the earthen material within the bucket. The rigging assembly for a dragline bucket includes a variety of components for supporting and controlling the dragline bucket. Conventional dragline rigging assemblies include a pair of drag chains attached to the front of the bucket for pulling the bucket through the earther material to be excavated, a plurality of hoist chains attached to the sidewalls of the bucket for hoisting the bucket, and one or two dump ropes for tipping the bucket. Each dump rope is arranged to extend over a dump block assembly (e.g., a pully assembly) that is linked to the hoist chains. Each dump rope is connected at one end to the front of the bucket and at the other end to the drag chains.

Depending on the rigging configuration and the desired degrees of freedom of movement of the dump block assemblies, the dump block assemblies in dragline rigging assemblies come in different configurations, such as a rigid mount configuration, a swing mount configuration, and a swivel mount configuration. For example, a dump block for a rigid mount configuration will have a different frame assembly design than a dump block for a swivel mount configuration. As a result, depending on the rigging configuration desired, different dump blocks are required.

In GB257656 to Savage, a jib for hoisting cables for a dragline bucket includes a block having two pulleys aligned vertically. The block is mounted to oscillate about two separate axis so that the pulleys can follow the lead of the hoisting cable when the drag line bucket swings during operation of the excavator.

SUMMARY OF THE DISCLOSURE

According to certain aspects of this disclosure, a dump block assembly for a dragline bucket rigging assembly includes a frame assembly having a first side frame and a second side frame attached to and parallel to the first side frame, a sheave pin fixably mounted to and extending between the first side frame and the second side frame, and a dump block sheave disposed between the first side frame and the second side frame and rotatably mounted on the sheave pin. The first side frame includes a first attachment portion for mounting the dump block assembly within the rigging assembly, the first attachment portion having a first upper connection portion, a first lower connection portion opposite the first upper connection portion, and a first central connection portion spaced apart from and in between the first upper connection portion and the first lower connection portion. The second side frame includes a second attachment portion for mounting the dump block assembly within the rigging assembly, the second attachment portion having a second upper connection portion, a second lower connection portion opposite the second upper connection portion, and a second central connection portion spaced apart from and in between the second upper connection portion and the second lower connection portion.

In another aspect of the disclosure, an adapter for attaching a dump block assembly to a dragline rigging assembly includes a first adapter attachment portion configured to mount to a frame assembly of the dump block, and a second adapter attachment portion configured to mount the frame assembly to the rigging assembly. The forward attachment portion is Y-shaped and includes an upper adapter connection portion, a lower adapter connection portion opposite the upper adapter connection portion, and a central adapter connection portion spaced apart from and in between the upper adapter connection portion and the lower adapter connection portion.

In one embodiment, the second attachment portion includes a first bore at a first end portion of the second attachment portion, the first bore extending parallel to the first axis, and a second bore at a second end portion of the second attachment portion, a second end portion being opposite the first end portion, and the second bore extending parallel to the first axis. In another exemplary embodiment, the second attachment portion includes a bore adjacent the central adapter connection portion, the bore extending parallel to the first axis. In a further exemplary embodiment, the second attachment portion includes a bore adjacent the central adapter connection portion, the bore extending perpendicular to the first axis.

BRIEF DESCRIPTION OF THE DRAWINGS

Further features and advantages of the invention will become apparent from the description of embodiments using the accompanying drawings. In the drawings.

DETAILED DESCRIPTION

Figure 1:
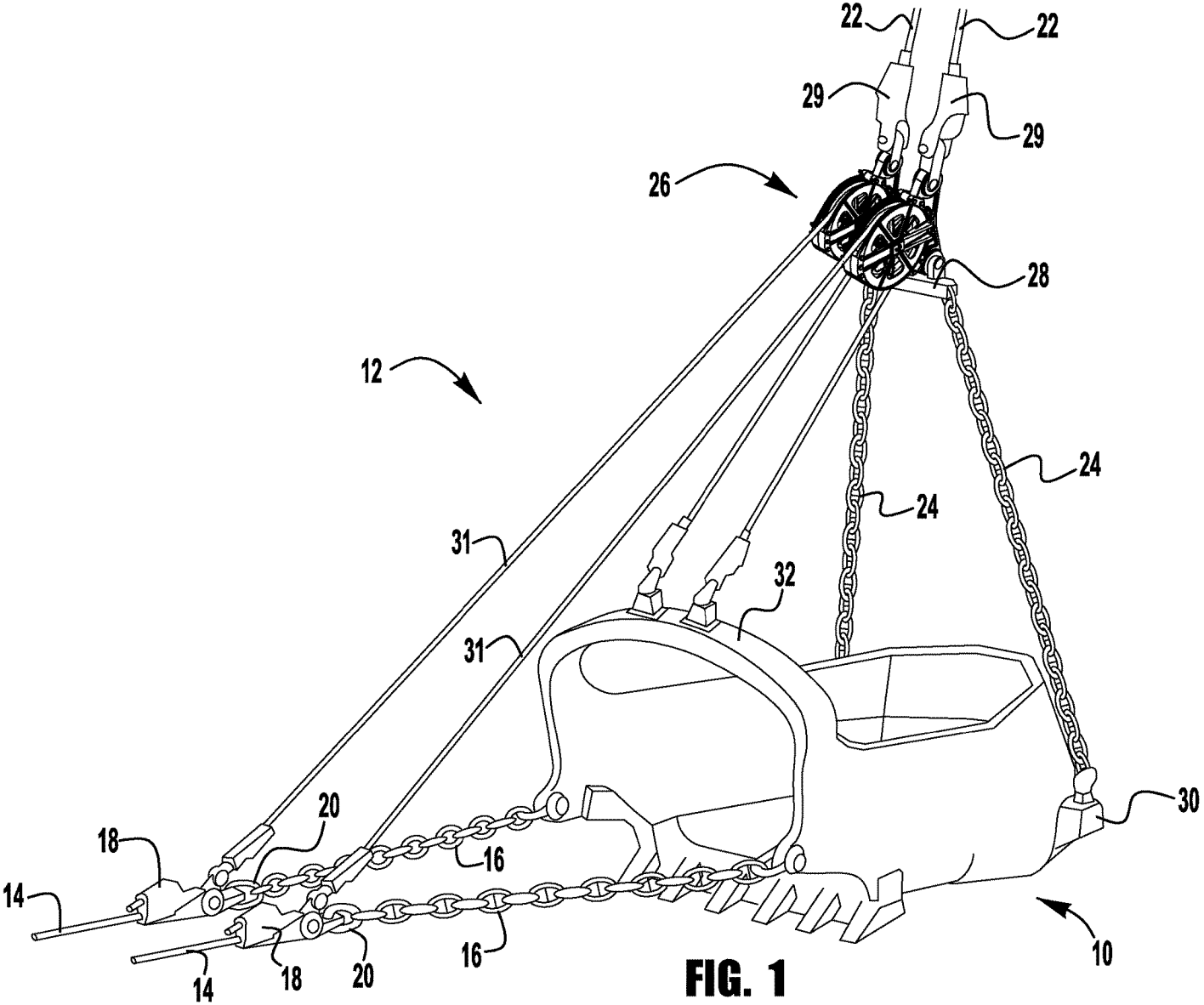
FIG. 1 is a perspective view of an exemplary embodiment of a dragline bucket rigging assembly.

Referring to FIG. 1, an exemplary embodiment of a dragline bucket 10 and a rigging assembly 12 for the dragline bucket is illustrated. In the illustrated embodiment, the rigging assembly 12 is set-up in a twin and rigid dump block configuration. The rigging assembly 12, however, may be configured in a variety of ways. For example, in other embodiments, the rigging assembly 12 may have a single dump block assembly and/or the dump block assemblies may be set-up in other configurations. The dump block assembly 26 disclosed herein, is capable of being configured in a variety of configurations, such as for example, a rigid configuration, a swivel configuration, and a swing configuration. The dump block assembly may be used in any of those configurations in a single or twin dump block set-up.

Figure 4:
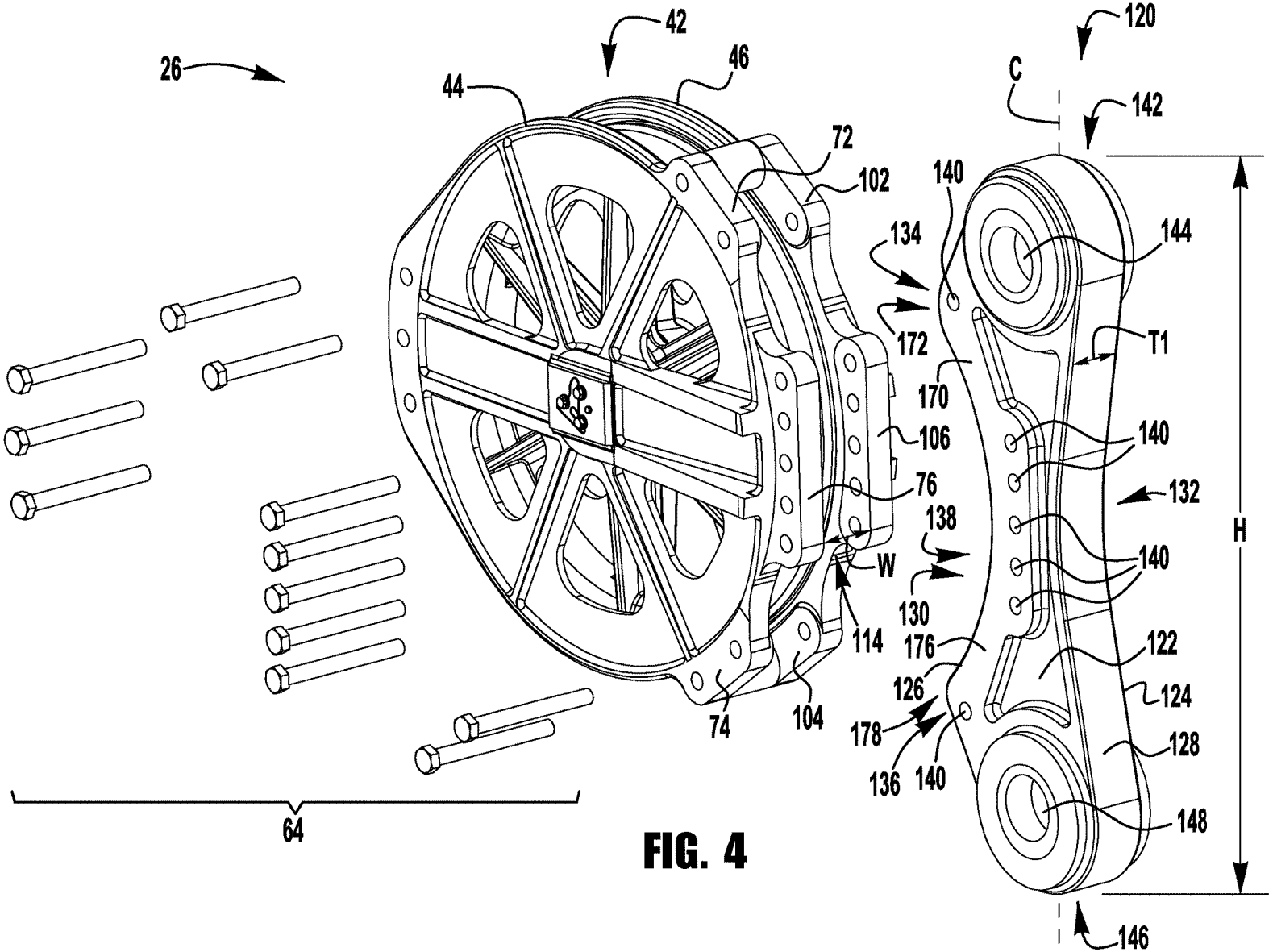
FIG. 4 is a partial exploded view of an exemplary embodiment of a dump block assembly in a rigid configuration.

As used in this specification, the term "rigid configuration" means a configuration in which the dump block assembly is mounted in a drag line rigging assembly in a fixed position relative to the hoist lines and hoist chains and is subjected to the same forces seen by the hoist ropes and hoist chain during hoisting. As shown in FIGS. 1 and 4, the exemplary embodiment of a rigid configuration has a two-pin, horizontal mount with an upper horizontal orientated pin mount and a lower horizontal pin mount.

Figure 6:
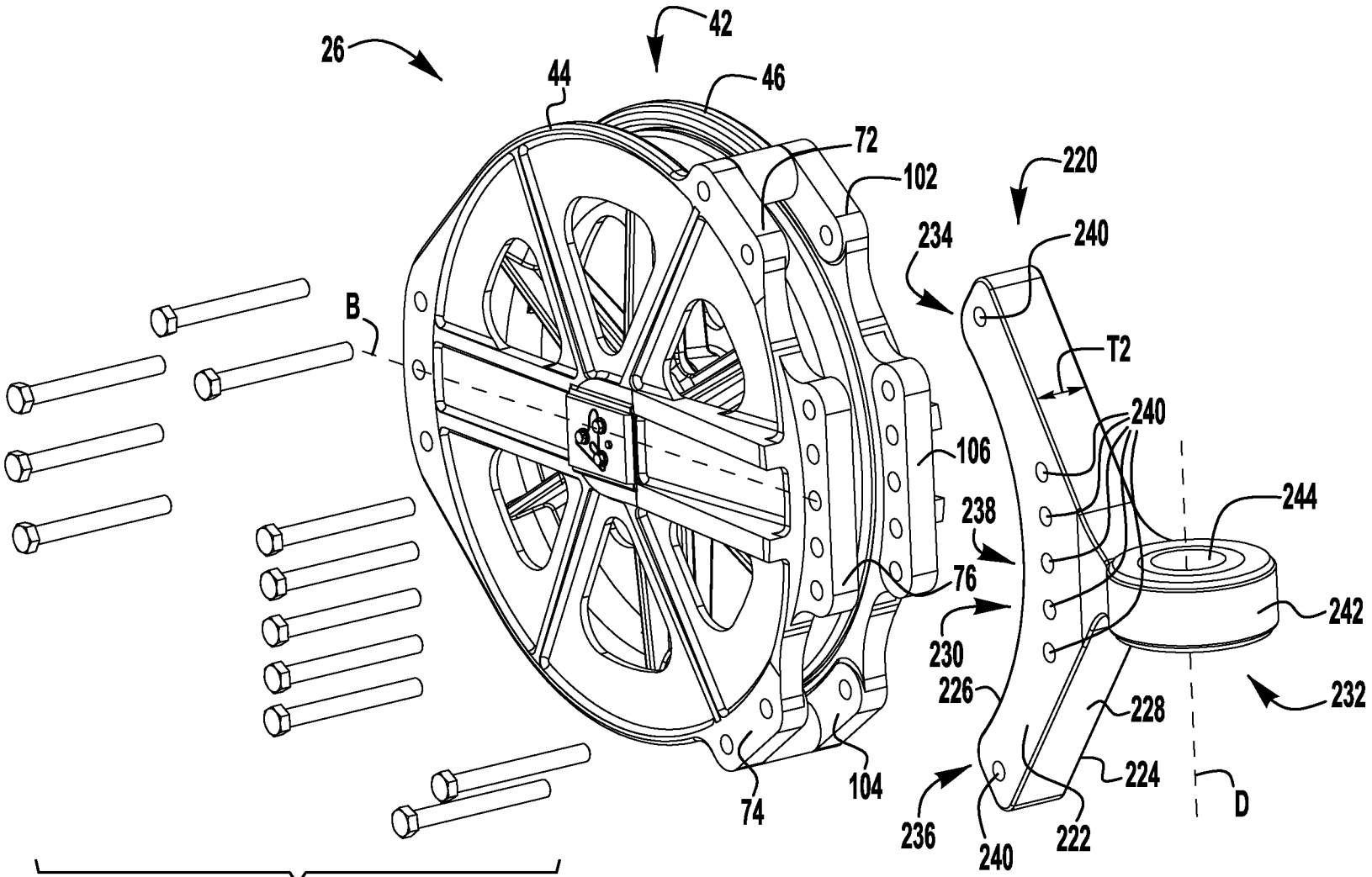
FIG. 6 is a partial exploded view of an exemplary embodiment of a dump block assembly in a swivel configuration.

As used in this specification, the term "swivel configuration" means a configuration in which a dump block assembly is mounted in a drag line rigging configuration such that the dump block assembly can pivot side-to-side (i.e. pivot about axis D in FIG. 6). As shown in FIG. 6, an exemplary embodiment of a swivel configuration has a single, vertically oriented pin mount.

Figure 8:
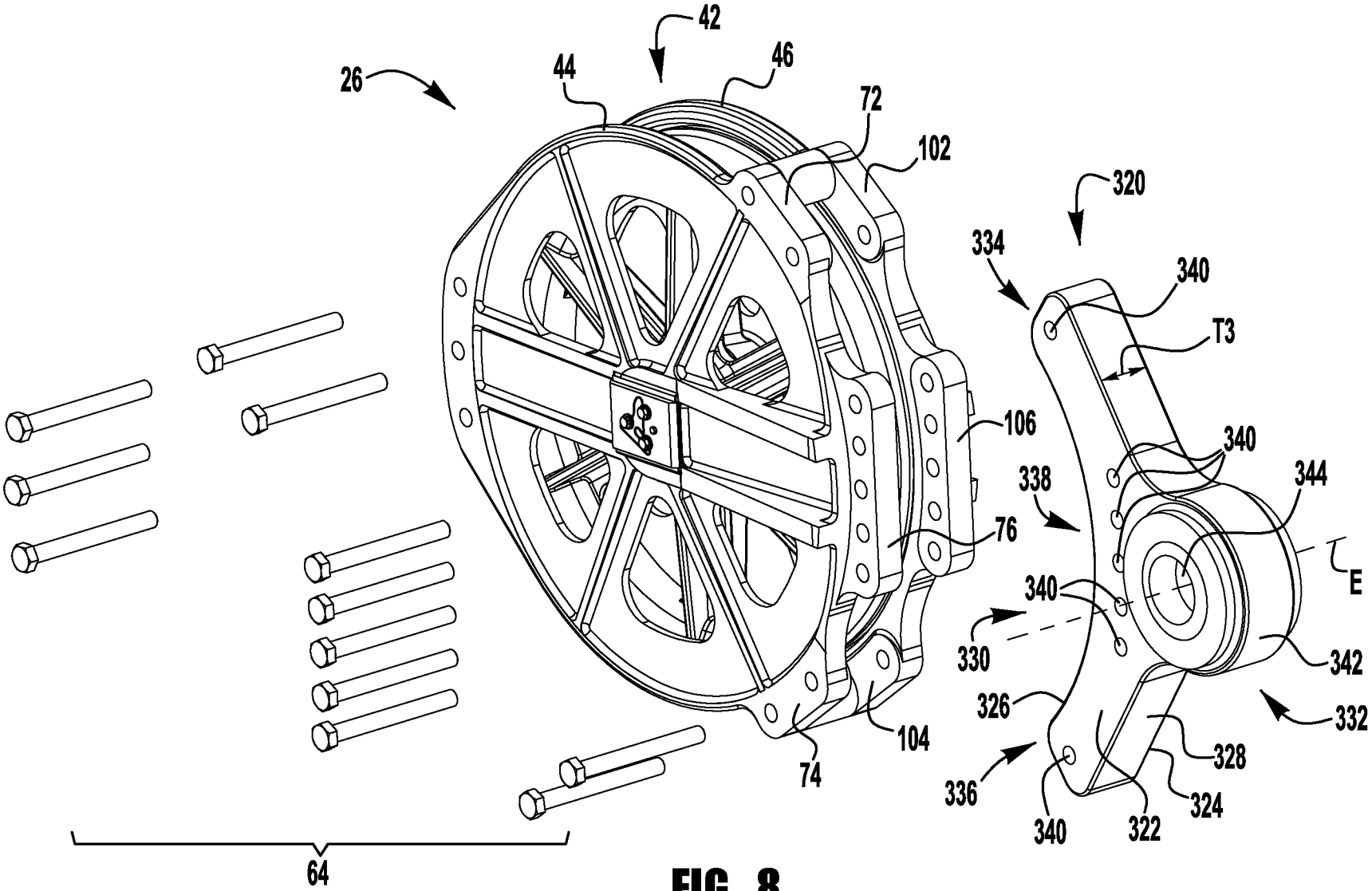
FIG. 8 is a partial exploded view of an exemplary embodiment of a dump block assembly in a swing configuration.

As used in this specification, the term "swing configuration" means a configuration in which a dump block assembly is mounted in a drag line rigging configuration such that the dump block assembly can pivot upward and downward (i.e. pivot about axis E in FIG. 8). As shown in FIG. 8, an exemplary embodiment of a swing configuration has a single horizontally oriented pin mount.

The rigging assembly 12 is arranged to facilitate a machine, such as dragline excavator (not shown), dragging the dragline bucket 10 through earthen material to be excavated. The rigging assembly 12 includes a pair of drag ropes 14. Each drag rope 14 is connected on one end to the dragline excavator (not shown) and on the other end to a corresponding drag chain 16 via a corresponding drag socket 18 and a drag clevis 20. Each drag chain 16 is connected to the front end of the dragline bucket 10.

The rigging assembly 12 is also arranged to facilitate the dragline excavator (not shown) raising and lowering the dragline bucket 10. The rigging assembly 12 includes a pair of hoist ropes 22. Each hoist rope 22 is connected on one end to the dragline excavator (not shown), via a boom on the excavator, and on the other end to a corresponding hoist chain 24 via a corresponding dump block assembly 26, a spreader bar 28, and a hoist socket 29. Each hoist chain 24 is connected to a sidewall 30 of the dragline bucket 10. Thus, in the illustrated rigid configuration, the dump block assemblies 26 support the weight of the dragline bucket 10 during hoisting.

The rigging assembly 12 is also arranged to facilitate the dragline excavator (not shown) dumping the dragline bucket 10. The rigging assembly 12 includes a pair of dump ropes 31. Each dump rope 31 is connected on one end to a corresponding drag rope 14 and on the other end to an arch 32 extending upward from the front of the dragline bucket 10. Each dump rope 31 is fed through a corresponding one of the dump block assemblies 26 which are positioned above the dragline bucket 10 in the rigging assembly 12.

Figure 2:
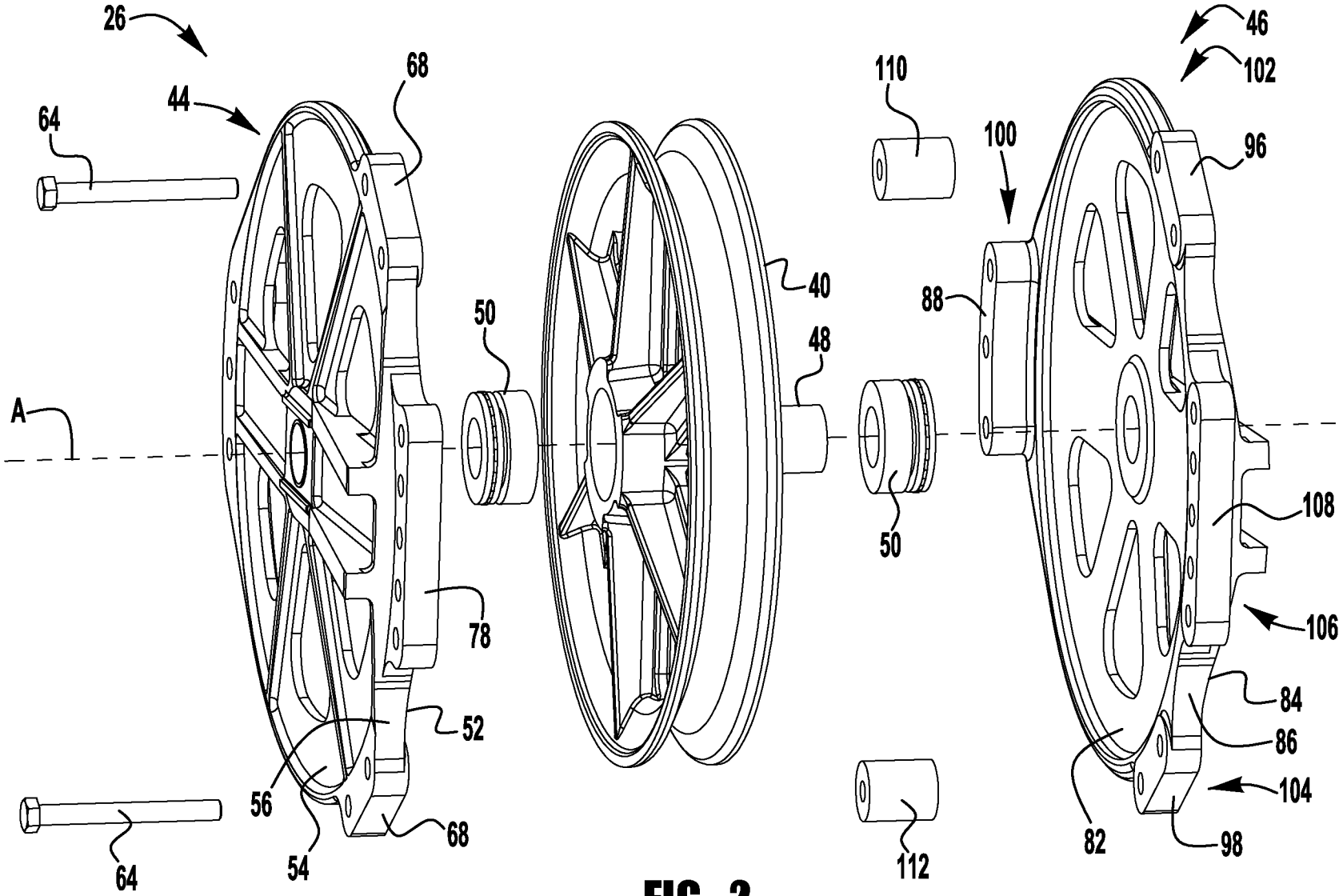
FIG. 2 is an exploded view of an exemplary embodiment of a dump block assembly for a dragline bucket rigging assembly of FIG. 1.
Figure 3:
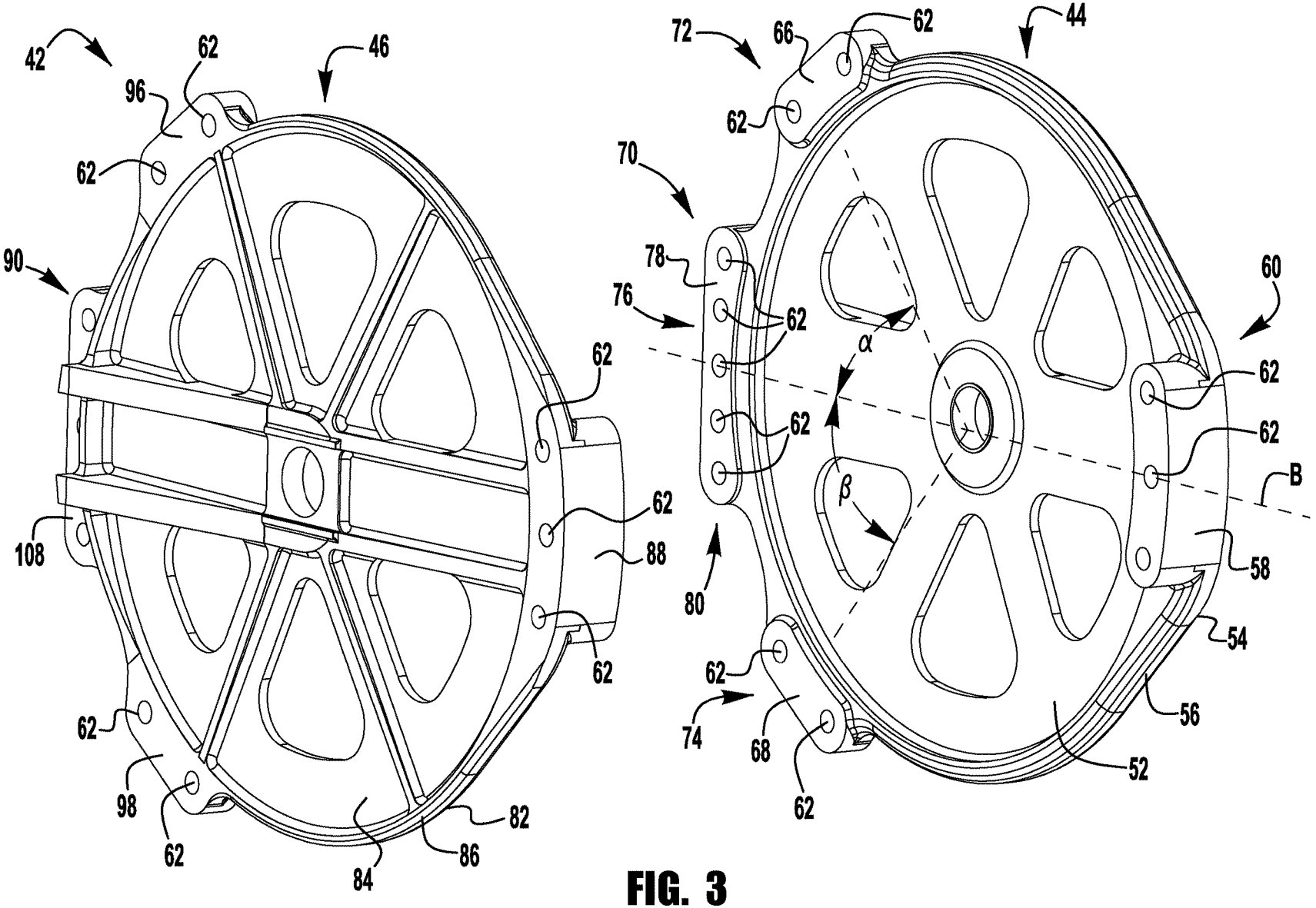
FIG. 3 is an exploded view of the frame assembly of the dump block assembly of FIG. 2.

Referring to FIGS. 2 and 3, an exemplary embodiment of the dump block assembly 26 is illustrated. The dump block assembly 26 may be configured in a variety of ways. Any configuration that provides the dump block assembly 26 the flexibility to be arranged in a variety of configurations, such as for example, a rigid configuration, a swivel configuration, and a swing configuration, may be used. In the illustrated embodiment, the dump block assembly 26 includes a dump block sheave 40 rotatably mounted within a frame assembly 42 (FIG. 3) to rotate about an axis A. The frame assembly 42 includes a first side frame 44 and a second side frame 46 attached to and parallel to the first side frame 44. In the illustrated embodiment, the first side frame 44 and the second side frame 46 are identically configured but mirror images of each other. In other embodiments, however, the first side frame 44 and the second side frame 46 may be shaped, sized, and/or configured differently.

The dump block assembly 26 includes a sheave pin 48 fixably mounted to and extending between the first side frame 44 and the second side frame 46. The dump block sheave 40 is disposed between the first side frame 44 and the second side frame 46 and rotatably mounted on the sheave pin 48 via a pair of tapered roller bearings sets 50.

The first side frame 44 is generally disk-shaped and includes a first inner side surface 52, a first outer side surface 54 spaced apart from and generally parallel to the first inner side surface 52, and a first circumferential edge 56 extending between the first inner side surface 52 and the first outer side surface 54. The first side frame 44 includes a first boss 58 extending from the first inner side surface 52 at a front portion 60 of the first side frame 44. The first boss 58 includes one or more attachment points, such as through bores 62, for receiving fasteners 64, such as bolts, for attaching the first side frame 44 to the second side frame 46.

The first side frame 44 may also include a first upper radial projection 66 extending radially from the first circumferential edge 56 and a first lower radial projection 68 extending radially from the first circumferential edge 56 opposite the first upper radial projection 66. Each of the first upper radial projection 66 and the first lower radial projection 68 include one or more attachment points, such as through bores 62, for receiving fasteners 64, such as bolts, for attaching the first side frame 44 to the second side frame 46.

The first side frame 44 may also include a first attachment portion 70 for mounting the dump block assembly 26 within the rigging assembly 12. The first attachment portion 70 may include a first upper connection portion 72, a first lower connection portion 74 opposite the first upper connection portion 72, and a first central connection portion 76 spaced apart from and in between the first upper connection portion 72 and the first lower connection portion 74.

In the illustrated embodiment, the first upper connection portion 72 includes one or more attachment points, such as one or more through bores 62, positioned on the first upper radial projection 66. Likewise, the first lower connection portion 74 includes one or more attachment points, such as one or more through bores 62, positioned on the first lower radial projection 68. In other embodiments, however, the first upper connection portion 72 and the first lower connection portion 74 may be separate from the first upper radial projection 66 and the first lower connection portion 74, respectively.

The first central connection portion 76 is configured as a first central radial projection 78 extending radially from the first circumferential edge 56 at a rear portion 80 of the first side frame 44. The first central radial projection 78 includes one or more attachment points, such as one or more through bores 62, for receiving fasteners 64, such as bolts. In the illustrated embodiment, the first central radial projection 78 includes five through bores 62 aligned generally perpendicular to the longitudinal axis A. In other embodiments, the number and arraignment of attachment points may differ.

In the illustrated embodiment, the first central radial projection 78 is generally opposite the first boss 58. In the illustrated embodiment, both the first boss 58 and the first central radial projection 78 are centered on a longitudinal axis B. The first upper radial projection 66 and the first lower radial projection 68 are positioned along the first circumferential edge 56 closer to the first central radial projection 78 than to the first boss 58. In the illustrated embodiment, the first upper radial projection 66 is positioned at an angle α in the range of 30-60 degrees along the first circumferential edge 56 from the longitudinal axis B and the first lower radial projection 68 is positioned at an angle β in the range of 30-60 deg. along the first circumferential edge 56 from the longitudinal axis B in a direction opposite the first upper radial projection 66. In the illustrated embodiment, the first side frame 44 is symmetric about the longitudinal axis B, thus the angle α is equal to the angle β. In other embodiments, however, the first side frame 44 may not be symmetric about the longitudinal axis B.

As previously indicated, in the illustrated embodiment, the second side frame 46 is identical to the first side frame 44 but presented in mirror image. Thus, the description of the first side frame 44 applies equally to the second side frame 46. For example, as with the first side frame 44, the second side frame 46 includes a second inner side surface 82, a second outer side surface 84 spaced apart from and generally parallel to the second inner side surface 82, and a second circumferential edge 86 extending between the second inner side surface 82 and the second outer side surface 84. The second side frame 46 includes a second boss 88 having one or more through bores 62 for receiving fasteners 64. The second side frame 46 also includes a second upper radial projection 96 extending radially from the second circumferential edge 86 and a second lower radial projection 98 extending radially from the second circumferential edge 86 opposite the second upper radial projection 96. Each of the second upper radial projection 96 and the second lower radial projection 98 include one or more attachment points, such as through bores 62, for receiving fasteners 64.

The second side frame 46 includes a second attachment portion 100 having a second upper connection portion 102, a second lower connection portion 104 opposite the second upper connection portion 102, and a second central connection portion 106, spaced apart from and in between the second upper connection portion 102 and the second lower connection portion 104. The first central connection portion 106 is configured as a second central radial projection 108 extending radially from the second circumferential edge 86 at a rear portion 90 of the second side frame 46.

Each of the second upper connection portion 102, the second lower connection portion 104, and a second central connection portion 106 includes one or more attachment points, such as one or more through bores 62, for receiving fasteners 64. In the illustrated embodiment, the second upper connection portion 102 is positioned on the second upper radial projection 96 and the second lower connection portion 104 is positioned on the second lower radial projection 98. In other embodiments, however, the second upper connection portion 102 and the second lower connection portion 104 may be separate from the second upper radial projection 96 and the second lower radial projection 98, respectively.

In an assembled state, the first side frame 44 and the second side frame 46 are arranged side-by-side such that the first inner side surface 52 is parallel to and spaced apart from the second inner side surface 82 and the first boss 58 abuts the second boss 88. One or more of the through bores 62 in the first boss 58 are aligned with corresponding through bores 62 in the second boss 88 and fasteners 64 are received through the aligned bores 62 to secure the first side frame 44 and the second side frame 46 together. In the illustrated embodiment, three fasteners 64 are used to attach the first boss 58 to the second boss 88.

In addition, the first upper radial projection 66 is spaced apart from and parallel to the second upper radial projection 96 and the first lower radial projection 68 is spaced apart from and parallel to the second lower radial projection 98. One or more of the through bores 62 in the first upper radial projection 66 are aligned with corresponding through bores 62 in the second upper radial projection 96 and one or more of the through bores 62 in the first upper radial projection 66 are aligned with corresponding through bores in the second upper radial projection 96. Fasteners 64 are received through the aligned bores 62 to secure the first side frame 44 and the second side frame 46 together. An upper roller 110 is rotatably mounted on one of the fasteners 64 extending between the first upper radial projection 66 and the second upper radial projection 96. In other embodiments, a plurality of upper rollers 110 may be mounted between the first upper radial projection 66 and the second upper radial projection 96. A lower roller 112 is rotatably mounted on one of the fasteners 64 extending between the first lower radial projection 68 and the second lower radial projection 98. In other embodiments, a plurality of lower rollers 112 may be mounted between the first lower radial projection 68 and the second lower radial projection 98.

In the assembled state, the first central connection portion 76 and the second central connection portion 106 are spaced apart and parallel to each other with one or more of the through bores 62 in the first central connection portion 76 aligned with a corresponding one or more through bores 62 in the second central connection portion 106. The spacing between the first central connection portion 76 and the second central connection portion 106, between the first upper radial projection 66 and the second upper radial projection 96, and between the first lower radial projection 68 and the second lower radial projection 98 is configured to receive and retain an adapter such that the dump block assembly 26 may be mounted in a variety of dump block configurations, such as for example, a rigid configuration, a swing configuration, and a swivel configuration. In the illustrated embodiment, the first side frame 44 is attached to the second side frame 46 such that the first attachment portion 70 and the second attachment portion 100 form a gap 114 therebetween having a width W.

Referring to FIG. 4, the dump block assembly 26 including a rigid configuration adapter 120 is illustrated. The rigid configuration adapter 120 may be configured in a variety of ways. Any configuration that can be attached to the dump block frame assembly 42 to allow the dump block assembly 26 to be mounted in a rigid configuration within the rigging assembly 12 may be used. In the exemplary embodiment, the rigid configuration adapter 120 has an elongate body extending along a longitudinal axis C. The rigid configuration adapter 120 includes a first face 122, a second face 124 opposite the first face 122, a front edge 126, and a rear edge 128 opposite the front edge 126. The rigid configuration adapter 120 has a height H that is greater than a diameter of the frame assembly 42 and a thickness T1, at least at the front edge 126, that is configured to be partially received between the first side frame 44 and the second side frame 46.

The rigid configuration adapter 120 had a forward attachment portion 130 adapted to mount to the dump block frame assembly 42 and a rearward attachment portion 132 adapted to mount the dump block assembly 26 within the rigging assembly 12. In the illustrated embodiment, the forward attachment portion 130 is generally Y-shaped or curved and includes an upper adapter connection portion 134, a lower adapter connection portion 136 opposite the upper adapter connection portion 134, and a central adapter connection portion 138 spaced apart from and in between the upper adapter connection portion 134 and the lower adapter connection portion 136. In one embodiment, the forward attachment portion 130 includes a first leg 170 having a first distal end portion 172 defining the upper adapter connection portion 134 and a second leg 176 opposite the first leg 170, having a second distal end portion 178 defining the lower adapter connection portion 136.

The forward attachment portion 130 is shaped such the forward attachment portion 130 can be received between the first side frame 44 and the second side frame 46. Each of the upper adapter connection portion 134, the lower adapter connection portion 136, and the central adapter connection portion 138 include one or more through bores 140 for receiving fasteners 64. In the illustrated embodiment, the upper and lower adapter connection portions 134, 136 each include a single through bore 140 and the central adapter connection portion 138 includes five aligned through bores 140. In other embodiments, however, the number of through bores 140 in the upper, lower, and central adapter connection portions 134, 136, 138 may be differ from the illustrated embodiment.

The rearward attachment portion 132 includes a top end 142 at least partially defined by a top bore 144 extending generally perpendicular to the longitudinal axis C and a bottom end 146 at least partially defined by a bottom bore 148 extending generally perpendicular to the longitudinal axis C. The top bore 144 and the bottom bore 148 are configured to facilitate the dump block assembly 26 being mounted within the rigging assembly 12 in a rigid configuration.

When assembled, the Y-shape or curved shape of the forward attachment portion 130 is configured such that when the forward attachment portion 130 is received between the first side frame 44 and the second side frame 46, one or more through bores 140 in the forward attachment portion 130 are aligned with one or more through bores 62 in the first attachment portion 70 and in the second attachment portion 100 of the dump block frame assembly 42. In one exemplary embodiment, the forward attachment portion 130 is curved to generally follow the radius of curvature of the dump block frame assembly 42.

In the illustrated embodiment, the through bore 140 in the upper adapter connection portion 134 is aligned with a through bore 62 in each of the first upper connection portion 72 and the second upper connection portion 102 and one of the fasteners 64 is received through the aligned through bores 62, 140. Likewise, the through bore 140 in the lower adapter connection portion 136 is aligned with a through bore 62 in each of the first lower connection portion 74 and the second lower connection portion 104 and one of the fasteners 64 is received through the aligned through bores 62, 140. Further, the through bores 140 in the central adapter connection portion 138 are aligned with the through bores 62 in each of the first central connection portion 76 and the second central connection portion 106 and fasteners 64 are received through the each of the aligned through bores 62, 140.

As shown in FIG. 1 and FIG. 4, the assembled dump block assembly 26 is configured to be mounted in a rigid configuration within the rigging assembly 12. A pair of assembled dump block assemblies 26 may be used in a twin dump block arrangement or, in other embodiments, a single dump block assembly 26 may be used in a single dump block arrangement.

Figure 5:
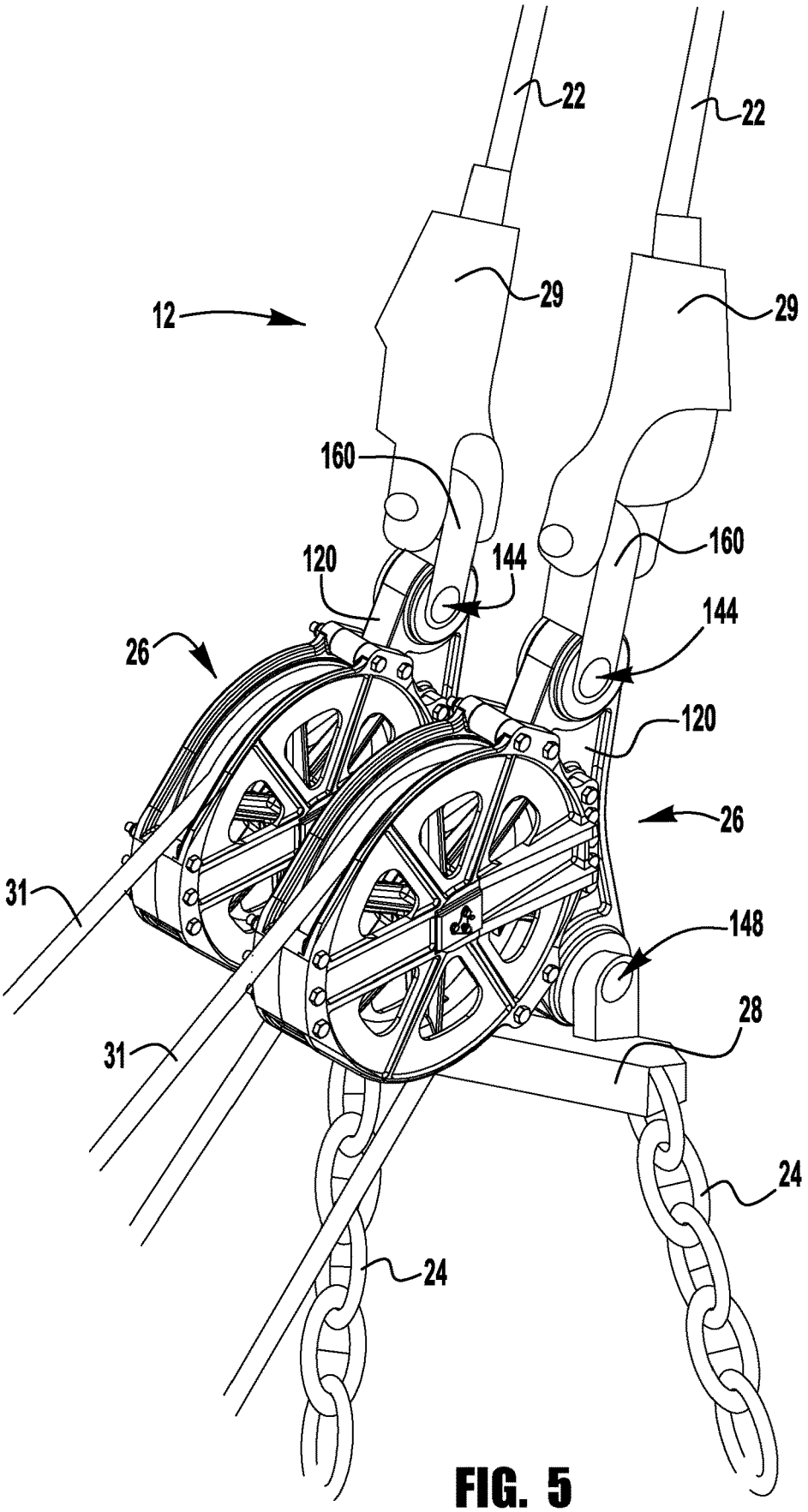
FIG. 5 is a partial perspective view of the dump block assembly of FIG. 4 installed in a dragline rigging assembly.

As shown in FIG. 1 and FIG. 5, the top bore 144 is pin mounted to an opposite plane link 160 via a horizontal pin (not shown) and the opposite plane link 160 is attached to one of the hoist ropes 22 via one of the hoist sockets 29. The bottom bore 148 is attached to the spreader bar 28 via a horizontal pin (not shown) and the spreader bar 28 is attached to one of the hoist chains 24. Thus, the dump block assembly 26 forms a link in the hoist system and is subjected to the forces seen by the hoist ropes 22 and hoist chains 24 during hoisting.

Referring to FIG. 6, the dump block assembly 26 including a swivel configuration adapter 220 is illustrated. The swivel configuration adapter 220 may be configured in a variety of ways. Any configuration that can be attached to the dump block frame assembly 42 to allow the dump block assembly 26 to be mounted in a swivel configuration may be used. In the exemplary embodiment, the swivel configuration adapter 220 includes a first face 222, a second face 224 opposite the first face 222, a front edge 226, and a rear edge 228 opposite the front edge 226. The swivel configuration adapter 220 has a thickness T2, at least at the front edge 226, that is configured to be partially received between the first side frame 44 and the second side frame 46.

The swivel configuration adapter 220 had a forward attachment portion 230 adapted to mount to the dump block frame assembly 42 and a rearward attachment portion 232 adapted to mount the dump block assembly 26 within the rigging assembly 12. In some embodiments, the forward attachment portion 230 is identical to the forward attachment portion 130 of the rigid configuration adapter of FIG. 4. In the illustrated embodiment, the forward attachment portion 230 is generally Y-shaped or curved and includes an upper adapter connection portion 234, a lower adapter connection portion 236 opposite the upper adapter connection portion 234, and a central adapter connection portion 238 spaced apart from and in between the upper adapter connection portion 234 and the lower adapter connection portion 236.

The forward attachment portion 230 is shaped such the forward attachment portion 230 can be received between the first side frame 44 and the second side frame 46. Each of the upper adapter connection portion 234, the lower adapter connection portion 236, and a central adapter connection portion 238 include one or more through bores 240. In the illustrated embodiment, the upper and lower adapter connection portions 234, 236 each include a single through bore 240 and the central adapter connection portion 238 includes five aligned through bores 240. In other embodiments, however, the number of through bores 240 in the upper, lower, and central adapter connection portions 234, 236, 238 may be differ from the illustrated embodiment.

The rearward attachment portion 232 includes a projection 242 extending rearward from the rear edge 228. The projection 242 includes a swivel bore 244 extending along axis D which is perpendicular to the longitudinal axis B of the dump block frame assembly 42. The swivel bore 244 is configured to facilitate the dump block assembly 26 being mounted within the rigging assembly 12 in the swivel configuration.

When assembled, the Y-shape or curved shape of the forward attachment portion 230 is configured such that when the forward attachment portion 230 is received between the first side frame 44 and the second side frame 46, one or more of the through bores 240 in the forward attachment portion 230 are aligned with one or more of the through bores 62 in the first attachment portion 70 and in the second attachment portion 100 of the dump block frame assembly 42. In one exemplary embodiment, the forward attachment portion 230 is curved to generally follow the radius of curvature of the dump block frame assembly 42.

In the illustrated embodiment, the through bore 240 in the upper adapter connection portion 234 is aligned with a through bore 62 in each of the first upper connection portion 72 and the second upper connection portion 102 and one of the fasteners 64 is received through the aligned through bores 62, 240. Likewise, the through bore 240 in the lower adapter connection portion 236 is aligned with a through bore 62 in each of the first lower connection portion 74 and the second lower connection portion 104 and one of the fasteners 64 is received through the aligned through bores 62, 240. Further, the through bores 240 in the central adapter connection portion 238 are aligned with the through bores 62 in each of the first central connection portion 76 and the second central connection portion 106 and fasteners 64 are received through the each of the aligned through bores 62, 240.

Figure 7:
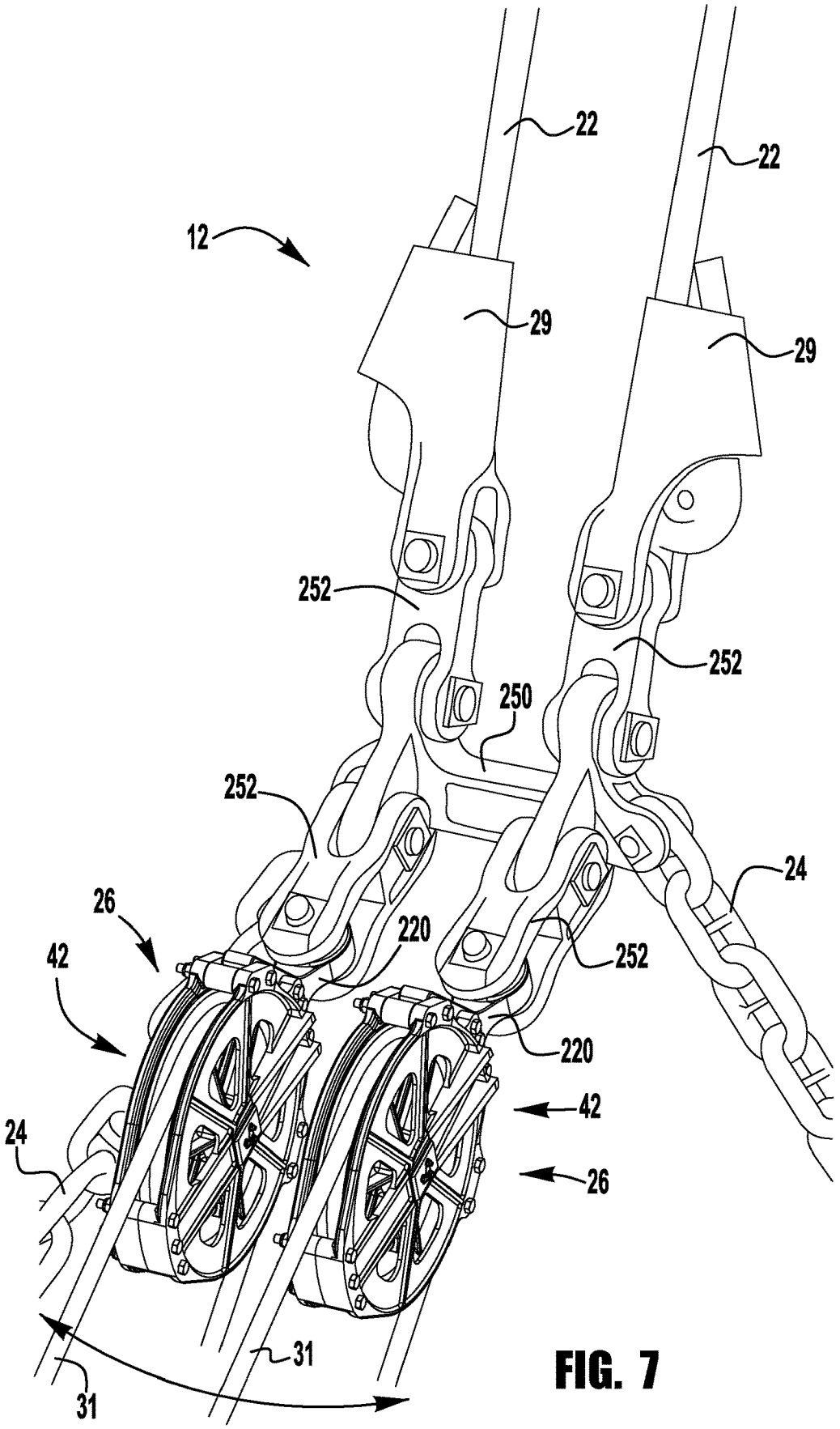
FIG. 7 is a partial perspective view of the dump block assembly of FIG. 6 installed in a dragline rigging assembly.

As shown in FIG. 7, the assembled dump block assembly 26 is configured to be mounted in a swivel configuration within the rigging assembly 12. A pair of assembled dump block assemblies 26 may be used in a twin dump block arrangement or, in other embodiments, a single dump block assembly 26 may be used in a single dump block arrangement.

The exemplary rigging assembly 12 includes an upper hoist spreader 250, a pair of opposite plane links 252, and a pair of hoist sockets 29 that are used to connect the hoist ropes 22 to the hoist chains 24. The swivel bore 244 is pin mounted to an opposite plane link 252 via a vertical pin (not shown) and the opposite plane link 252 is mounted off of the front of the upper hoist spreader 250. Thus, the dump block assembly 26 can swivel side to side, as shown by arrows in FIG. 6. and is not subjected to the forces seen by the hoist ropes 22 and hoist chains 24 during hoisting.

Referring to FIG. 8, the dump block assembly 26 including a swing configuration adapter 320 is illustrated. The swing configuration adapter 320 may be configured in a variety of ways. Any configuration that can be attached to the dump block frame assembly 42 to allow the dump block assembly 26 to be mounted in a swing configuration may be used. In the exemplary embodiment, the swing configuration adapter 320 includes a first face 322, a second face 324 opposite the first face 322, a front edge 326, and a rear edge 328 opposite the front edge 326. The swing configuration adapter 320 has a thickness T3, at least at the front edge 326, that is configured to be partially received between the first side frame 44 and the second side frame 46.

The swing configuration adapter 320 had a forward attachment portion 330 adapted to mount to the dump block frame assembly 42 and a rearward attachment portion 332 adapted to mount the dump block assembly 26 within the rigging assembly 12. In the illustrated embodiment, the forward attachment portion 330 is generally Y-shaped or curved and includes an upper adapter connection portion 334, a lower adapter connection portion 336 opposite the upper adapter connection portion 334, and a central adapter connection portion 338 spaced apart from and in between the upper adapter connection portion 334 and the lower adapter connection portion 336. In some embodiments, the forward attachment portion 330 is identical to the forward attachment portion 130 of the rigid configuration adapter of FIG. 4.

The forward attachment portion 330 is shaped such the forward attachment portion 330 can be received between the first side frame 44 and the second side frame 46. Each of the upper adapter connection portion 334, the lower adapter connection portion 336, and a central adapter connection portion 338 include one or more through bores 340. In the illustrated embodiment, the upper and lower adapter connection portions 334, 336 each include a single through bore 340 and the central adapter connection portion 338 includes five aligned through bores 340. In other embodiments, however, the number of through bores 340 in the upper, lower, and central adapter connection portions 334, 336, 338 may be differ from the illustrated embodiment.

The rearward attachment portion 332 includes a projection 342 extending rearward from the rear edge 328. The projection 342 includes a swing bore 344 extending along axis E which is perpendicular to the longitudinal axis A of the dump block frame assembly 42. The swing bore 344 is configured to facilitate the dump block assembly 26 being mounted within the rigging assembly 12 in a swing configuration.

When assembled, the Y-shape or curved shape of the forward attachment portion 330 is configured such that when the forward attachment portion 330 is received between the first side frame 44 and the second side frame 46, one or more through bores in the 340 in the forward attachment portion 330 are aligned with one or more through bores 62 in the first attachment portion 70 and in the second attachment portion 100 of the dump block frame assembly 42. In one exemplary embodiment, the forward attachment portion 330 is curved to generally follow the radius of curvature of the dump block frame assembly 42.

In the illustrated embodiment, the through bore 340 in the upper adapter connection portion 334 is aligned with a through bore 62 in each of the first upper connection portion 72 and the second upper connection portion 102 and one of the fasteners 64 is received through the aligned through bores 62, 340. Likewise, the through bore 340 in the lower adapter connection portion 336 is aligned with a through bore 62 in each of the first lower connection portion 74 and the second lower connection portion 104 and one of the fasteners 64 is received through the aligned through bores 62, 340. Further, the through bores 340 in the central adapter connection portion 338 are aligned with the through bores 62 in each of the first central connection portion 76 and the second central connection portion 106 and fasteners 64 are received through the each of the aligned through bores 62, 340.

Figure 9:
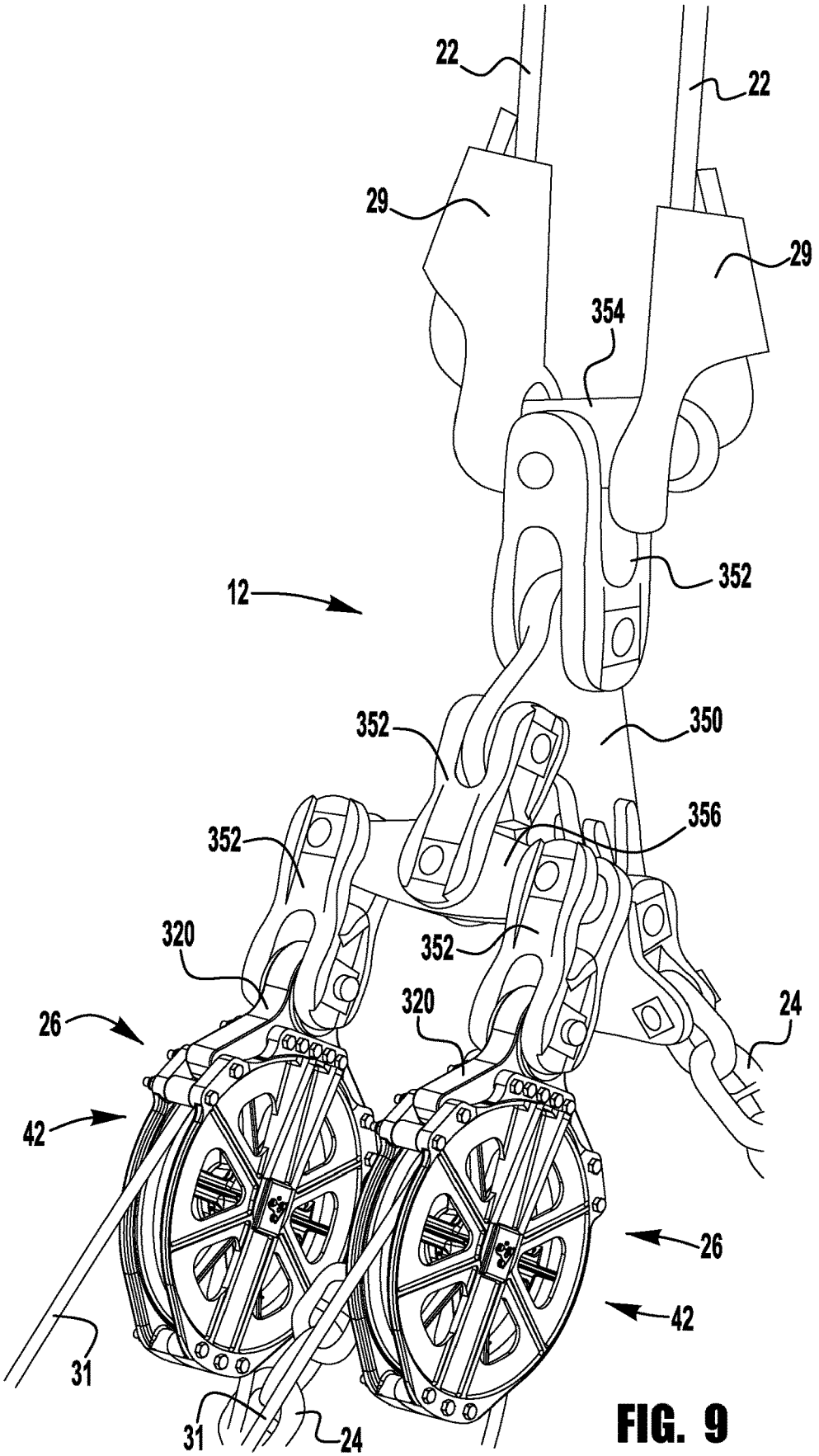
FIG. 9 is a partial perspective view of the dump block assembly of FIG. 8 installed in a dragline rigging assembly.

As shown in FIG. 9, the assembled dump block assembly 26 is configured to be mounted in a swing configuration within the rigging assembly 12. A pair of assembled dump block assemblies 26 may be used in a twin dump block arrangement or, in other embodiments, a single dump block assembly 26 may be used in a single dump block arrangement.

The exemplary rigging assembly 12 includes a pickup link 350, an opposite plane link 352, and a hoist equalizer 354 that is used to connect the hoist ropes 22 to the hoist chains 24. The swing bore 344 is pin mounted to an opposite plane link 352 via a horizontal pin (not shown) and the opposite plane link 352 is mounted off the front of the pickup link 350 via a dump equalizer 356 and another opposite plane links 352. Thus, the dump block assembly 26 is not subjected to the forces seen by the hoist ropes 22 and hoist chains 24 during hoisting. The swing bore 344 is pivotably attached such that the dump block assembly 26 can pivot about axis E, FIG. 8.

INDUSTRIAL APPLICABILITY

The present disclosure is applicable to dragline bucket rigging assemblies 12. The disclosed dump block frame assembly 42 is universal in that it can be used in a variety of dragline bucket rigging assembly configurations, such as for example, a rigid configuration, a swivel configuration, and a swing configuration. The dump block frame assembly 42 includes attachment portions 70, 100 that can couple to an adapter that is specifically configured for mounting within the rigging assembly 12 in a specific configuration.

For example, the rigid configuration adapter 120 may be attached to the dump block frame assembly 42 allowing the dump block assembly 22 to be mounted within the rigging assembly 12 in a rigid configuration. Since, in a rigid configuration, the dump block frame assembly 42 is subjected to the large forces seen by the hoist ropes 22 and hoist chain 24 during hoisting, the connection between the rigid configuration adapter 120, the rigging assembly 12 and the dump block frame assembly 42 must be robust. The disclosed dump block frame assembly 42 includes three attachment locations between the rigid configuration adapter 120 and the dump block frame assembly 42 to withstand the large forces seen by the dump block frame assembly 42 in a rigid configuration. In particular, both the first side frame 44 and second side frame 46 include complementary upper connection portions 72, 102, lower connection portions 74, 104, and central connection portions 76, 106 to ensure the dump block assembly 26 is sturdy enough to operating in a rigid configuration.

The same universal dump block frame assembly 42 can be used with a different adapter, such as the swivel configuration adapter 220 and the swing configuration adapter 320, to mount the dump block assembly 26 within the rigging assembly 12 in a different configuration, such as a swivel or swing configuration.

While the disclosed embodiments have been illustrated and described in detail in the drawings and foregoing description, such illustration and description are to be considered as exemplary and not restrictive in character, it being understood that only certain exemplary embodiments have been shown and described and that all changes and modifications that come within the scope of the disclosure are desired to be protected.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A dump block assembly for a dragline rigging assembly, the dump block assembly comprising:

a frame assembly having a first side frame and a second side frame attached to and parallel to the first side frame;

a sheave pin fixably mounted to and extending between the first side frame and the second side frame; and a dump block sheave disposed between the first side frame and the second side frame and rotatably mounted on the sheave pin;

wherein the first side frame includes a first attachment portion to selectively couple with a plurality of adapters for mounting the dump block assembly within the rigging assembly, the first attachment portion having a first upper connection portion, a first lower connection portion opposite the first upper connection portion, and a first central connection portion spaced apart from and in between the first upper connection portion and the first lower connection portion, wherein the second side frame includes a second attachment portion to selectively couple with a plurality of adapters for mounting the dump block assembly within the rigging assembly, the second attachment portion having a second upper connection portion, a second lower connection portion opposite the second upper connection portion, and a second central connection portion spaced apart from and in between the second upper connection portion and the second lower connection portion;

wherein the plurality of adapters is adapted to mount the dump block assembly in a rigid configuration, a swivel configuration, and a swing configuration.

2. The dump block assembly according to claim 1, wherein the first attachment portion is parallel to the second attachment portion.

3. The dump block assembly according to claim 1, wherein the first central connection portion is evenly spaced between the first upper connection portion and the second upper connection portion.

4. The dump block assembly according to claim 3, wherein the first central connection portion includes a plurality of attachment points.

5. The dump block assembly according to claim 4, wherein each of the plurality of attachment points on the first central connection portion are aligned with each of a plurality of attachment points on the second central connection portion.

6. The dump block assembly according to claim 1, wherein the first upper connection portion is formed in a first upper radial projection extending radially from a circumferential edge on the first side frame.

7. The dump block assembly according to claim 1, wherein the first lower connection portion is formed in a first lower radial projection extending radially from the circumferential edge and the first central connection portion is formed in a first central radial projection extending radially from the circumferential edge.

8. The dump block assembly according to claim 1, wherein a first roller extends between the first upper connection portion and the second upper connection portion and an attachment point on the first upper connection portion is aligned with an attachment point on the second upper connection portion.

9. The dump block assembly according to claim 8, wherein a second roller extends between the first lower connection portion and the second lower connection portion and an attachment point on the first lower connection portion is aligned with an attachment point on the second lower connection portion.

10. The dump block assembly according to claim 1, one of the plurality of adpaters is a rigid configuration adapter configured to be received between the first attachment portion and the second attachment portion for adapting the dump block assembly to mount in a rigid dump block configuration.

11. The dump block assembly according to claim 10, wherein the rigid configuration adapter has a y-shaped forward attachment portion adapted to connect to the first and second upper connection portions, the first and second central connection portions, and the first and second lower connection portions.

12. The dump block assembly according to claim 11, wherein the first attachment portion and the second attachment portion form a gap therebetween having a width, and wherein at least a portion of the y-shaped forward attachment portion has a thickness that is less than the width.

13. The dump block assembly according to claim 1, wherein one of the plurality of adapters is a swivel configuration adapter configured to be received between the first attachment portion and the second attachment portion for adapting the dump block assembly to mount in a swivel dump block configuration.

14. The dump block assembly according to claim 1, wherein one of the plurality of adapters is a swing configuration adapter configured to be received between the first attachment portion and the second attachment portion for adapting the dump block assembly to mount in a swing dump block configuration.

* * * * *